United States Patent [19]

Holstein et al.

[11] Patent Number: 4,594,934

[45] Date of Patent: Jun. 17, 1986

[54] BURST FIRE CONTROL MECHANISM

[76] Inventors: John H. Holstein, 5304 N. Colonial #102, Fresno, Calif. 93704; Robert C. McCarty, 9425 Marcella Ave., Gilroy, Calif. 95020; Walter G. Parrish, 1286 E. Plymouth Way, Fresno, Calif. 93710

[21] Appl. No.: 558,284

[22] Filed: Dec. 5, 1983

[51] Int. Cl.[4] ..... F41D 11/10

[52] U.S. Cl. ..... 89/129.02

[58] Field of Search ..... 89/129.02

[56] References Cited

U.S. PATENT DOCUMENTS 3,345,914 10/1967 Newcomb et al. ..... 89/129.02

3,847,054 11/1974 Ruger et al. ..... 89/129.02

*Primary Examiner*—Charles T. Jordan

*Assistant Examiner*—Ted L. Parr

*Attorney, Agent, or Firm*—Shlesinger, Arkwright, Garvey & Fado

[57] ABSTRACT

A burst fire control mechanism for an automatic fire arm including a bolt longitudinally displaceably disposed in a receiver comprising a hammer mechanism pivotally mounted in the receiver; a trigger assembly pivotally mounted in the receiver including a portion engagable with the hammer mechanism for permitting the hammer mechanism to pivot; selector blade means for pre-selecting a number of rounds to be fired and having safety, semi-automatic and burst fire firing configurations pivotally mounted in the receiver rearward of the trigger assembly and including means engagable with the trigger assembly for selecting one of the safety, semi-automatic and burst fire firing configurations; a burst fire control mechanism, mounted in the receiver rearward of the selector blade means, including means engagable with the bolt for counting the pre-selected number of fired rounds and means engagable with the selector blade means after the pre-selected number of rounds have been fired and counted for causing the selector blade means to engage the trigger means thereby selecting the semi-automatic configuration to thus interrupt burst firing.

20 Claims, 13 Drawing Figures

FIG 7
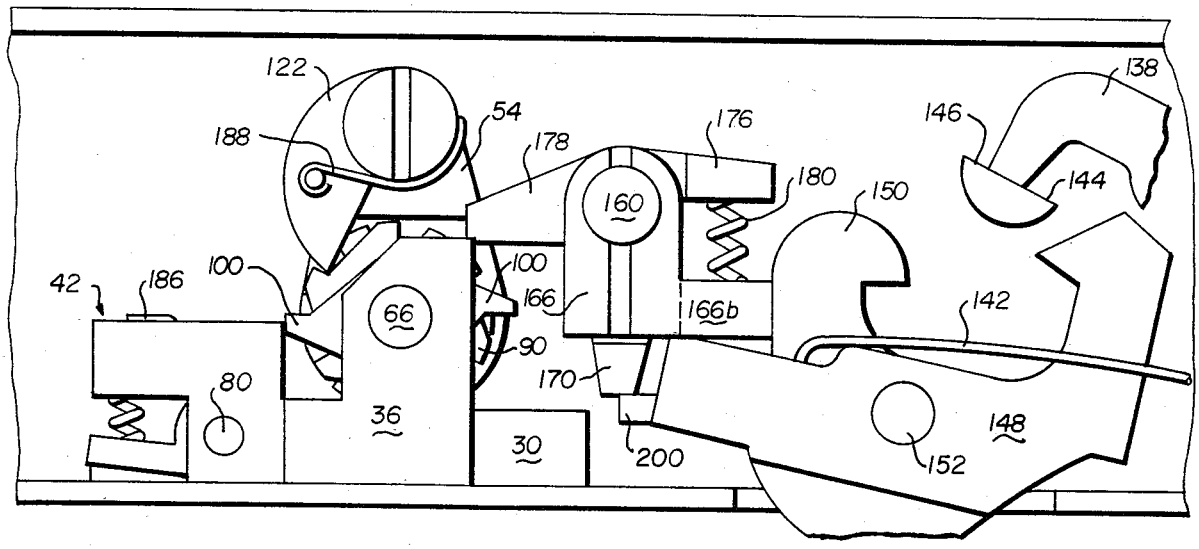
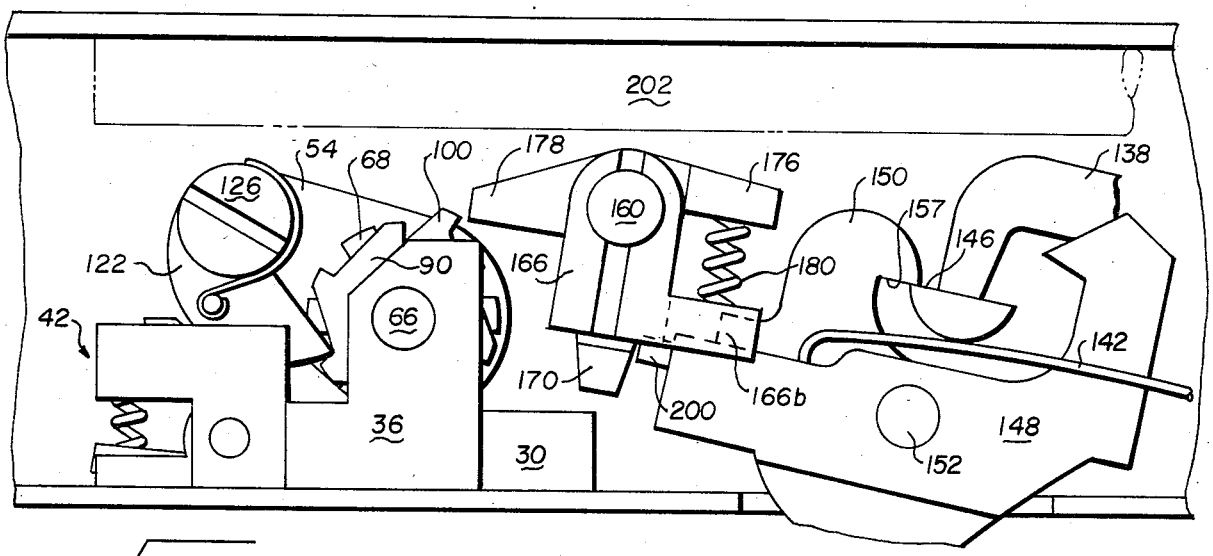
FIG 8
FIG 9
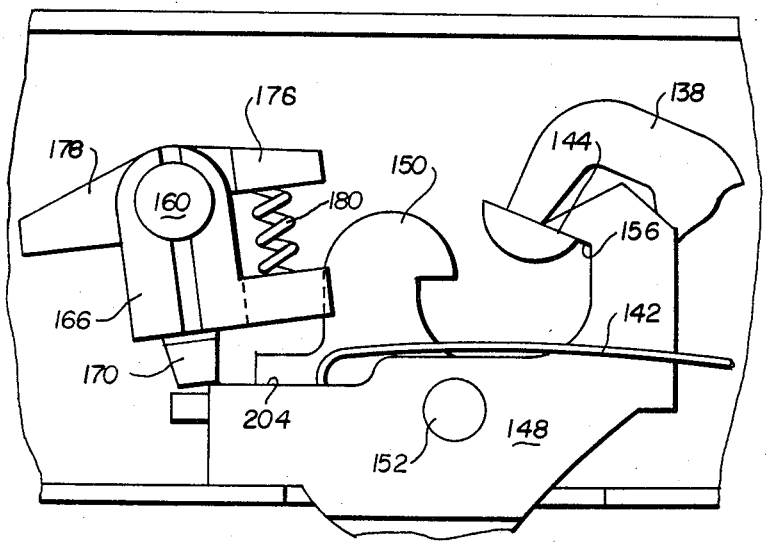

BURST FIRE CONTROL MECHANISM

BACKGROUND OF THE INVENTION

Conventional firearms generally operate in a single shot, semi-automatic or automatic firing configuration. In the semi-automatic firing configuration, the trigger must be pulled each time a round is to be fired although it is not necessary that the weapon be cocked as this function is performed automatically by the weapon system. An automatic firearm, on the other hand, is a weapon in which consecutive rounds of ammunition are fired for as long as the trigger mechanism is pulled. Automatic and semi-automatic weapons are well known in the art.

The firing of an automatic weapon must be controlled in order to prevent the rounds being fired from climbing out of the target area. Automatic firing of a weapon has a naturally occurring tendency to cause the weapon to pitch upwardly in the hands of the person firing the weapon. Additionally, the weapon also has a tendency to pull to one side or the other with the composite resultant effect that sustained firing of the automatic weapon results in rounds being fired out of the target area after only a relatively few number of rounds have been fired. This tendency to climb and pull results in a waste of rounds with a resultant increase in danger of stray rounds causing serious damage or injury as well as the added expense of non-targeted rounds.

An additional problem with automatic weapons is the heat generated. The explosive gases which propel the bullet have an elevated temperature with the effect that the weapon becomes heated as successive rounds are fired. It can therefore be appreciated that the longer the burst, the greater the heat absorbed by the weapon and the need to eliminate that absorbed heat in order to permit repeated successful operation of the weapon.

In view of the above deficiencies and disadvantages of automatic weapons, a weapon capable of firing a pre-selected number of rounds to minimize weapon climb out of the target area, as well as to minimize the heat absorbed by the weapon during firing of the rounds, is desirable. The present invention discloses and claims a novel and unique means for adapting an automatic weapon in order to control the number of rounds fired when the weapon is in the automatic or burst fire firing configuration. The present invention discloses a means for permitting a pre-selected number of rounds to be fired in the burst fire firing configuration and that after that number of rounds have been fired the weapon automatically is placed into the semi-automatic firing configuration. In another embodiment of the invention, means are provided to permit the weapon to remain in the automatic firing configuration even after the pre-selected number of rounds have been fired.

The present invention discloses a selector blade assembly positioned rearwardly of the trigger and having a portion engageable with the trigger for selecting any one of semi-automatic, burst fire, or safety firing configurations. The burst fire control mechanism is positioned rearwardly of the selector blade assembly and is adapted for cooperating with the weapon bolt for counting the number of rounds fired. After a pre-selected number of rounds have been fired, the burst fire control mechanism activates the selector blade assembly for switching the selector blade from the burst fire configuration to the semi-automatic firing configuration.

Newcomb, et al, U.S. Pat. No. 3,345,914, discloses a two-round burst fire mechanism for an automatic rifle in which the counter mechanism is positioned rearwardly of the trigger but in which the means for selecting the firing configuration is positioned above the trigger assembly and, consequently, in front of the counter mechanism. Additionally, Newcomb fails to disclose the unique burst fire control mechanism of the present invention.

Ruger, et al, U.S. Pat. No. 3,847,054, discloses a burst fire control mechanism. The counting mechanism and the selector mechanism of Ruger are positioned forwardly and above the trigger assembly and, therefore, fail to disclose the burst fire control mechanism of the present invention.

OBJECTS AND SUMMARY OF THE INVENTION

It is a primary object of the disclosed invention to overcome the disadvantages above described.

It is an additional object of the disclosed invention to provide a burst fire control mechanism which is longitudinally rearwardly positioned relative to the selector blade mechanism and which is engageable with the bolt for registering or counting when a round has been fired.

Yet an additional object of the disclosed invention is to provide a burst fire control mechanism which is easily positionable and removable from the weapon receiver in order to facilitate conversion of a conventional automatic weapon to a burst fire controlled weapon.

Still yet another object of the disclosed invention is to provide a burst fire control mechanism in which the number of rounds fired per burst may be quickly and easily altered.

Yet still a further object of the disclosed invention is to provide a burst fire control mechanism having an auxiliary mechanism permitting automatic firing even after the pre-selected number of rounds have been fired.

Yet still another object of the disclosed invention is to provide a burst fire control mechanism having a pivotal pawl arm assembly operatively associated with a ratchet mechanism and engagable with the longitudinally displaceable bolt for thereby registering or counting the number of rounds fired.

Still yet another object of the disclosed invention is to provide a burst fire control mechanism permitting the weapon to be operated in any one of burst fire, semi-automatic, or safety configurations.

Yet an additional object of the disclosed invention is to provide means for absorbing the recoil forces transferred to the burst fire control mechanism by engagement with the displaceable bolt.

A further object of the disclosed invention is to provide a burst fire control mechanism in which the recoil absorbing means is not in engagement with the burst fire control mechanism prior to a round being fired in order to permit free rotation of the ratchet means and pivoting of the pawl means.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawing, wherein:

FIG. 7 is a fragmentary side elevational view of the burst fire control mechanism of FIG. 3 with the selector blade in the burst fire control configuration.

FIG. 8 is a fragmentary side elevational view as in FIG. 7 with the selector blade in the semi-automatic configuration.

FIG. 9 is a fragmentary side elevational view similar to FIG. 7 in which the selector blade assembly is in the safety configuration;

DESCRIPTION OF THE INVENTION

Figure 1:
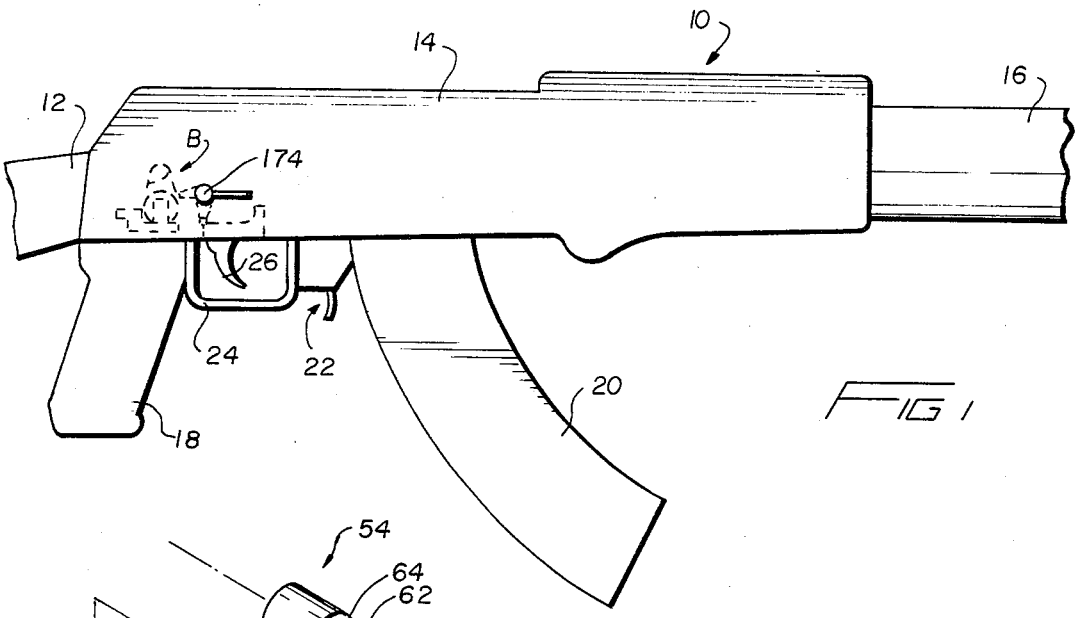
FIG. 1 is a fragmentary right-side elevational view with portions shown in phantom of the burst fire control mechanism of our invention installed in an automatic firearm.

An automatic firearm 10, such as a Kalashnikov AK-47, is best shown in FIG. 1. The automatic firearm 10 includes a stock 12, a receiver assembly 14 secured to the stock 12 and a barrel assembly 16 longitudinally extending from the receiver 14. A handle 18 extends downwardly from the rearward portion of receiver assembly 14 and an ammunition magazine 20, of a type well known in the art, communicates with the receiver 14 in a well known manner. The ammunition magazine 20 includes means for conveying a plurality of rounds (not shown) to the receiver assembly 14 in order to be fired from the barrel assembly 16 so as to strike the target. A magazine catch and release mechanism 22 extends downwardly from receiver assembly 14 rearward of ammunition magazine 20. A trigger guard 24 is disposed between handle 18 and magazine release and catch assembly 22 and encloses a trigger assembly 26. The burst fire control mechanism B is positioned in receiver assembly 14 rearward of trigger assembly 26, as will be explained hereinafter later.

Figure 2:
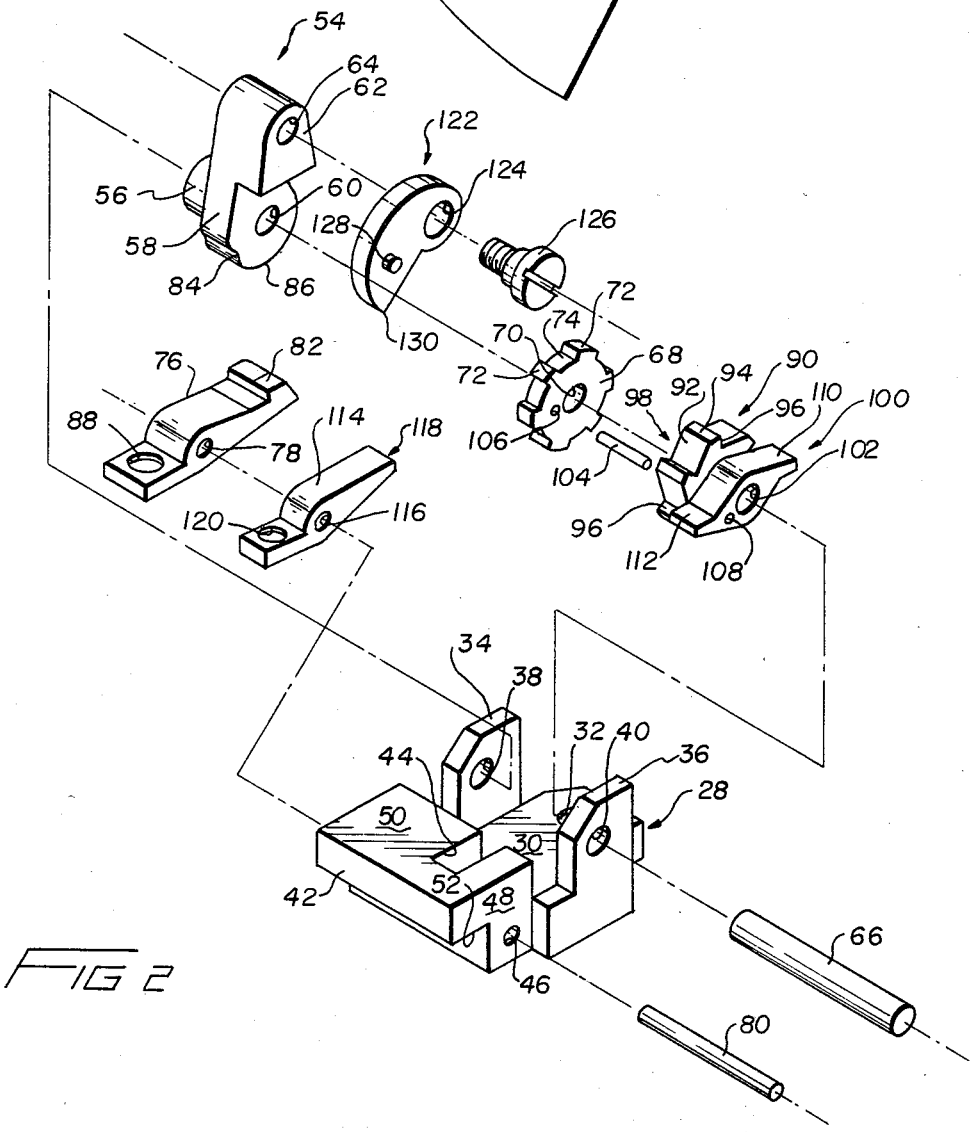
FIG. 2 is an exploded schematic perspective view of the burst fire control mechanism of our invention with dashed lines indicating positioning of parts.

Burst fire control mechanism B, as best shown in FIG. 2, includes a mounting bracket 28. Mounting bracket 28 includes a bottom plate 30 having an aperture 32 to permit mounting bracket 28 to be secured within receiver assembly 14. Sidewall members 34 and 36 extend upwardly from bottom plate 30 and include aligned coaxial apertures 38 and 40, respectively. A back support 42 extends upwardly from bottom plate 30 rearward of sidewall members 34 and 36 and includes a slot 44 and aligned apertures 46, of which only one of the apertures 46 is shown. Aperture 46 is in sidewall 48 of back support 42 and a similar aperture 46 would be on the opposite side of back support 42 adjacent sidewall member 44. Top plate 50 of back support 42 extends rearwardly beyond sidewall 48 so that a recess 52 is disposed below top plate 50.

Pawl arm 54 is, preferably, manufactured from steel or any other suitably hard material. Pawl arm 54 is generally oblong shaped and includes a lower pivot 56 extending outwardly from main body portion 58. Main body portion 58 and lower pivot 56 include an aperture 60. Top support 62 extends outwardly from main body portion 58 in a direction opposed from that to which lower pivot 56 extends and is spaced from aperture 60 and is of a generally triangular shape with the base of the triangle facing downwardly. Top support 62 includes an aperture, preferably threaded, 64. Pawl arm 54 is mounted to mounting bracket 28 with pivot 56 adjacent sidewall member 34 by means of pin 66 passing through aperture 40 of sidewall 36 and through aperture 60 of pawl arm 54 and thence through aperture 38 of sidewall 34. In this way, pawl arm 54 is free to pivot on an axis defined by pin 66. It should be noted that top support 62 extends outwardly a substantial distance beyond main body portion 58, for reasons to be described herein later.

Detent wheel 68 is mounted to pin 66 passing through aperture 70 of detent wheel 68. Detent wheel 68 is mounted in the space below outwardly extending top support 62 and has a diameter less than the distance from the base of top support 62 to the bottom of pawl arm 54, in order that detent wheel 68 will be free to rotate on pin 66. Detent wheel 68 includes a number of outwardly extending teeth 72, preferably six in number, with an arcuate portion or notch 74 disposed between adjacent teeth 72 and notches 74 have a radius less than the radius of outwardly extending teeth 72.

A latch 76 having an aperture 78 is mounted by pin 80 spanning apertures 46 of back support 42. Latch 76 is of a length sufficient that finger portion 82 is aligned with aperture 60 of pawl arm 54. In this way, finger portion 82 will be engaged between one of the detents defined by outwardly extending teeth 72 and notches 74 when the pawl arm 54 has been pivoted rearwardly. Pawl arm 54 includes an inwardly extending camming surface 84 to permit latch 76 to engage one of notches 74. Generally, when pawl arm 54 is in the vertical or ready position, cam surface 86 presses downwardly on latch 76 so that finger portion 82 does not engage any of the detents of detent wheel 68. Latch 76 includes a recess 88 on the rear portion thereof for reasons to be explained herein later.

A ratchet wheel 90 having a coaxial aperture (not shown) coaxial with aperture 70 of detent wheel 68 is mounted to pin 66 in mounting bracket 28. Ratchet wheel 90 includes angularly disposed outer peripheral surfaces 92 connected to arcuate outer surface 94 and radially extending surface 96. In this way, the cooperating surfaces 92, 94 and 96 define a plurality of teeth 98 extending circumferentially around ratchet wheel 90. Preferably, there are six equiangularly spaced teeth 98 about ratchet wheel 90.

Trip pawl 100 having an aperture 102 coaxial with the aperture 70 of detent wheel 68 and the aperture (not shown) of ratchet wheel 90 is mounted to pin 66. Preferably, detent wheel 68, ratchet wheel 90, and trip pawl 100 are connected by means of pin 104 cooperating with aperture 106 of detent wheel 68, a similar aperture (not shown) of ratchet wheel 90, and aperture 108 of trip pawl 100. In this way, detent wheel 68, ratchet wheel 90 and trip pawl 100 are interconnected and rotate as one unit.

Trip pawl 100 includes outwardly extending fingers 110 and 112. Fingers 110 and 112 extend outwardly from pin 66 a distance greater than the radius of ratchet wheel 90 and detent wheel 68, for reasons to be explained herein later.

A hold pawl 114 having an aperture 116 is mounted on pin 80 adjacent latch 76 and aligned with ratchet wheel 90. Hold pawl 114 includes an outer finger portion 118 which is adapted for engaging the teeth 98 of ratchet wheel 90 when the pawl arm 54 is in the upright or ready position. In this way, the hold pawl 114 permits counterclockwise rotation of ratchet wheel 90, and therefore detent wheel 68 and trip pawl 100, while preventing clockwise rotation of ratchet wheel 90. Preferably, hold pawl 114 includes a recess 120, for reasons to be explained herein later.

A pawl 122 of a generally semi-circular shape and having an aperture 124 is secured by screw 126 to aperture 64 of top support 62 of pawl arm 54. Pawl 122 includes an outwardly extending lug 128 for reasons to be explained herein later. Pawl 122 includes a tooth engaging portion 130 which is adapted for engaging the teeth 98 of ratchet wheel 90.

As can be seen from the above, when pawl arm 54 pivots on the axis defined by pin 66, then pawl 122 with its tooth engaging portion 130 engages one of the teeth 98 of ratchet wheel 90 with the result that ratchet wheel 90, and detent wheel 68 and trip pawl 100, are rotated in the counterclockwise direction. Similarly, the camming surface 86 of pawl arm 54 depresses latch 76 so that finger portion 82 does not engage one of the detents of detent wheel 68 until the pawl arm 54 has been rotated on pin 66 a distance sufficient that cam surface 84 permits latch 76 to be upwardly displaced so that finger portion 82 engages one of the detents of the detent wheel 68. Correspondingly, after the pawl arm 54 has rotated this distance and rotated ratchet 90, the next one of the teeth 98 engages the finger portion 118 of hold pawl 114. In this way, the firing of one round will be counted and the recoil forces absorbed.

FIG. 3

The burst fire control mechanism B is shown mounted in receiver assembly 14 of firearm 10. Screw or bolt 132 extends upwardly through bottom member 134 of receiver assembly 14 and securely fastens mounting bracket 28, and burst fire control mechanism B therefore, inside receiver assembly 14. Bottom member 134 includes a slot 136 in order to permit trigger assembly 26 to extend downwardly below receiver assembly 14 so that the trigger 26 may be pulled by the weapon operator (not shown).

Hammer 138 is pivotally mounted on pin 140 and is spring loaded by means of spring 142 in order that hammer 138 will rotate forwardly on pin 140 so as to strike the explosive portion of the casing (not shown) of the round to be fired (not shown). Hammer 138 includes a hammer cock notch 144 and a disconnector notch 146.

The trigger assembly 26 is of a two-part assembly and includes a trigger 148 and a disconnector 150. Disconnector 150 and trigger 148 are coaxially mounted to pin 152 rearward of pin 140. A spring 154 is disposed between disconnector 150 and trigger 148 and tends to urge disconnector 150 upwardly. Trigger 148 includes a sear 156. Similarly, disconnector 150 includes a disconnector sear 157.

Figures 3, 4, 5, 6:
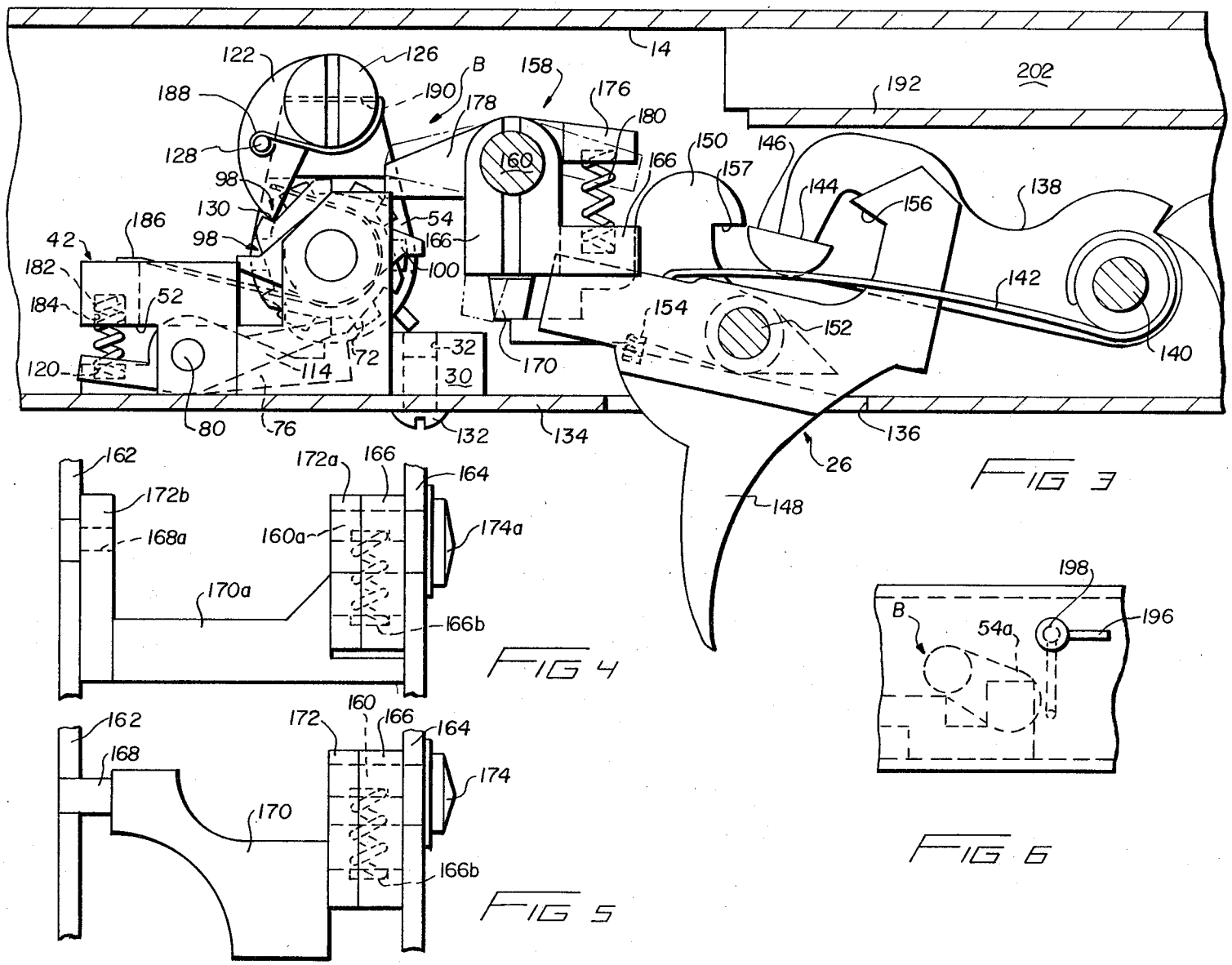
FIG. 3 is a cross-sectional view with portions broken away and with the movement of parts indicated in phantom lines of the burst fire control mechanism of FIG. 1 installed in the weapon of FIG. 1.
FIG. 4 is a front elevational view with portions of the receiver broken away illustrating the selector blade of our invention.
FIG. 5 is a front elevational view with portions of the receiver broken away of another embodiment of the selector blade of our invention.
FIG. 6 is a fragmentary right-side elevational view of another embodiment of the weapon of FIG. 1 and disclosing means for maintaining the burst fire control mechanism out of engagement with the selector blade.

FIGS. 4 and 5

A selector blade assembly 158 is mounted by pin or stub shaft 160 and is disposed between walls 162 and 164 extending generally upwardly parallel transverse of bottom wall 134 of receiver assembly 14. The selector blade assembly 158 is made independent of the selector control set handle 166 and is, therefore, free to pivot on stub shaft 160 extending through wall 164 and aligned pin 168 extending through wall 162. It should be noted that pivot 160 is positioned above trigger assembly 26 pivot 152 which is below pawl arm pivot 66. In this way, the selector blade 170 and its upstanding member 172 may be pivoted by selector handle 174, as is best shown in FIG. 5.

The embodiment of the selector blade assembly 158 shown in FIG. 4 is a modified form of the blade conventional with the firearm 10. In the embodiment in FIG. 4 the selector blade **170*a* and its upstanding wall members 172*a* and 172*b* pivot on pin 168*a* and stub shaft 160*a*. The selector blade 170*a* is pivotable by means of selector handle 174*a*. It will be noted that regardless of whether the embodiment of FIG. 4 or FIG. 5 selector blade assembly 158 is used, that the selector blade 170 and 170*a* extends downwardly below wall members 172 and 172*a***, for reasons to be explained herein later.

The selector blade assembly 158, whether of the embodiment of FIG. 4 or FIG. 5, includes a forwardly extending arm extension 176 and a rearwardly extending arm extension 178. A spring 180 is disposed between forward arm extension 176 and the bottom offset **166*b* of selector control 166 and tends to urge forward arm extension 176 upwardly with the effect of pivoting the selector blade assembly 158 on pin or stub shaft 160 so that rearward arm extension 178 is pivoted downwardly or in the countercockwise direction until the bottom portion of wall member 172 engages bottom offset 166*b*. Similarly, selector blade 170 which is integral with forward arm extension 176 and rearward extension 178 has a similar tendency to pivot about pin or stub shaft 160 because of the action of spring 180. It should be noted that rear arm extension 178, as best shown in FIG. 3, extends so that the rear arm extension 178 will be struck by trip pawl 100 should the trip pawl 100** have been rotated a sufficient degree of angularity.

As best shown in FIG. 3, a spring 182 is disposed in recess 120 of hold pawl 114 and extends upwardly into a similar recess 184 in top plate 50 with the effect of tending to press hold pawl 114 upwardly into engagement with one of the teeth 98 of ratchet wheel 90. Consequently, clockwise rotation of ratchet wheel 90 is inhibited. Another spring 186 extends between top plate 50 around pin 66 and against top support 62 of pawl arm 54 and has the effect of urging pawl arm 54 into the vertical or ready-to-count position from the horizontal count positon. Similarly, a spring 188 extends from lug 128 of pawl 122 through an aperture 190 in screw 126 and urges pawl 122 with its tooth contacting portion 130 to remain in contact with ratchet wheel 90.

FIG. 3 also discloses bottom plane support 192 which serves to guide the 130 to remain in contact with ratchet wheel 90.

Figure 12:
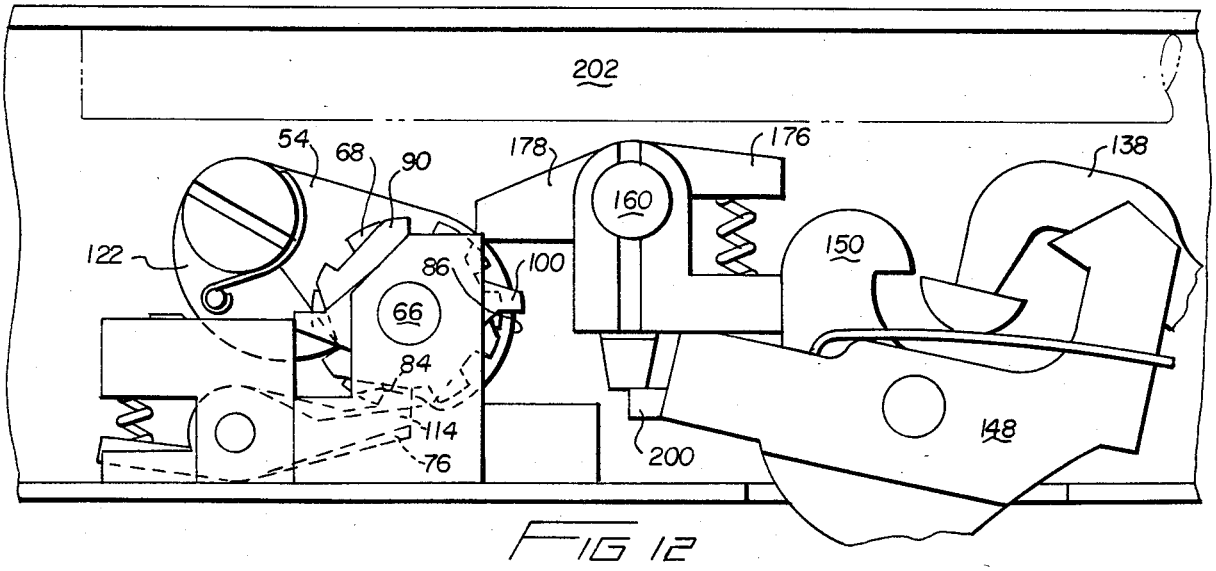

FIG. 3 also discloses bottom plane support 192 which serves to guide the bolt 202 of the firearm, which is best shown in FIG. 12, after the round (not shown) has been fired.

In the embodiment disclosed in FIG. 6, pawl arm 54*a* is engagable with arm 196 of rotatable handle 198. Rotation of handle 198 so that arm 196 engages the pawl arm 54*a* to be pivoted rearwardly so that the burst fire control mechanism B is disengaged, as will be explained herein later, so that an unlimited number of rounds may be fired by the firearm 10.

OPERATION

Operation of the burst fire control mechanism B requires the operator (not shown) to rotate selector handle 174 so that selector blade 170 is in any one of the firing configurations desired. Specifically, FIG. 7 discloses the selector blade assembly 170 pressing against the rearward portion 200 of disconnector 150 of trigger assembly 26. In this configuration, with the selector blade 170 pressing against the rearward portion 200 of disconnector 150, the firearm 10 is in the burst fire firing configuration.

In the configuration shown in FIG. 8, which also discloses the bolt 202 which is longitudinally rearwardly reciprocally displaceable in receiver 14 when a round (not shown) is fired, the selector blade assembly 170 is pivoted free of contact with the rearward portion 200 of the disconnector 150 of the trigger assembly 26. In this configuration, the firearm 10 is in the semi-automatic firing configuration.

In the configuration shown in FIG. 9, the selector blade assembly 170 presses against the foot portion 204 of trigger 148 with the result that the trigger 148 may not be squeezed or pulled and consequently cannot pivot and the firearm 10 cannot be fired therefore.

As best shown in FIG. 8, the pawl arm 54 pivots on the axis defined by pin 66 when the bolt 202 is longitudinally rearwardly displaced after a round (not shown) has been fired by the hammer 138 contacting the shell (not shown). The longitudinal rearward reciprocal displacement of the bolt 202 may be caused in any one of a number of means well known in the art. Upon the pawl arm 54 being contacted by the bolt 202, the pawl arm 54 pivots, or rotates, on pin 66 with the result that the pawl 122 and its tooth engaging portion 130 rotate ratchet wheel 90. The rotation of the pawl arm 54 is sufficient to advance the ratchet wheel at least 60°, in the preferred embodiment, so that the cam surface 84 of the pawl arm 54 will permit the finger portion 82 of the latch 76 to engage the next one of the detents of the detent wheel 68. The detent wheel 68 and the finger portion 82 of the latch 76 serve the important function of absorbing the recoil forces imparted to the pawl arm 54 caused by being struck by the rearwardly longitudinally moving bolt 202. The detent wheel 68 and the latch 76 further prevent the ratchet wheel 90 from rotating more than 60° so that the burst fire control mechanism B may keep an accurate registry or count of the number of rounds that have been fired. The hold pawl 114 with its finger portion 118, similarly engages the next one of the teeth 98 of the ratchet wheel 90 after the ratchet wheel 90 has rotated at least 60° and thereby further facilitates the registration and counting of the number of rounds being fired while preventing the ratchet wheel 90 from rotating clockwise when the hold pawl 54 pivots upwardly into the ready position after the bolt 202 moves forwardly into its battery position.

As best shown in FIG. 8, the disconnector sear 157 engages the disconnector notch 146 when the firearm is in the semi-automatic mode and, consequently, it is necessary that the trigger be pulled each time a round is desired to be fired. It will be noted, in FIG. 7, the disconnector notch 146 and the hammer cock notch 144 do not engage the disconnector 150 or the trigger 148 with the result that the hammer 138 is free to pivot forwardly to strike the shell (not shown) of the next round. In this way, the FIG. 7 embodiment permits simultaneous burst firing of multiple rounds while the configuration in FIG. 8 permits only one round to be fired with each pull of the trigger. Similarly, the configuration shown in FIG. 9 prohibits any movement of the trigger with the result that the trigger sear 156 engages the hammer cock notch 144 while the selector blade 170 engages the foot portion 204 of the trigger 148 and thereby, prevents firing of the firearm 10.

Figure 10:
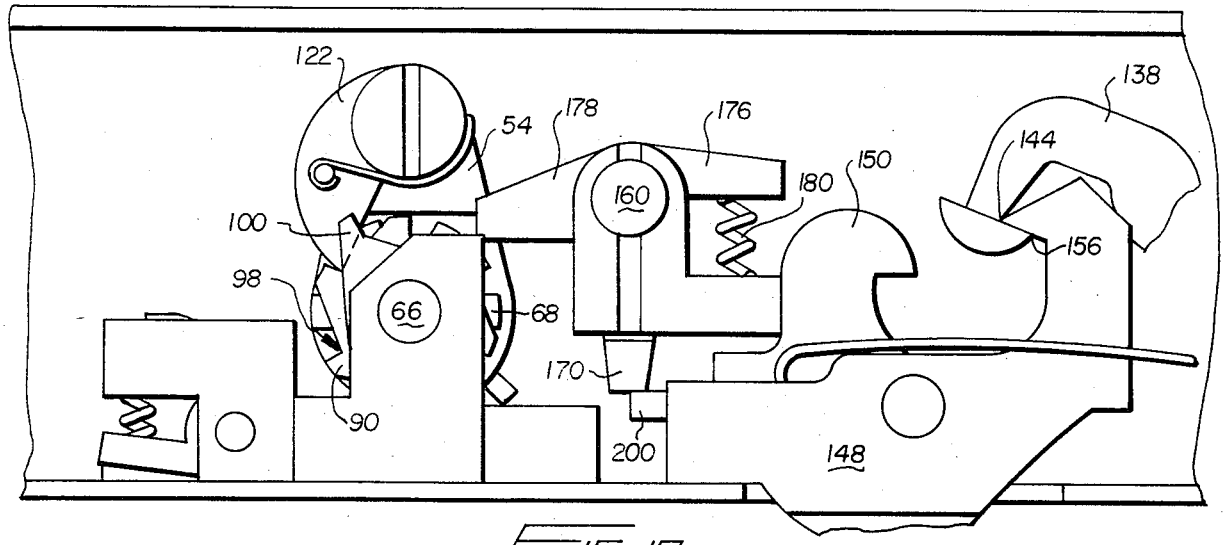
FIG. 10 is a fragmentary side elevational view of the burst fire control mechanism of FIG. 3 with the selector blade in the burst fire firing configuration before the trigger has been pulled.
Figure 11:
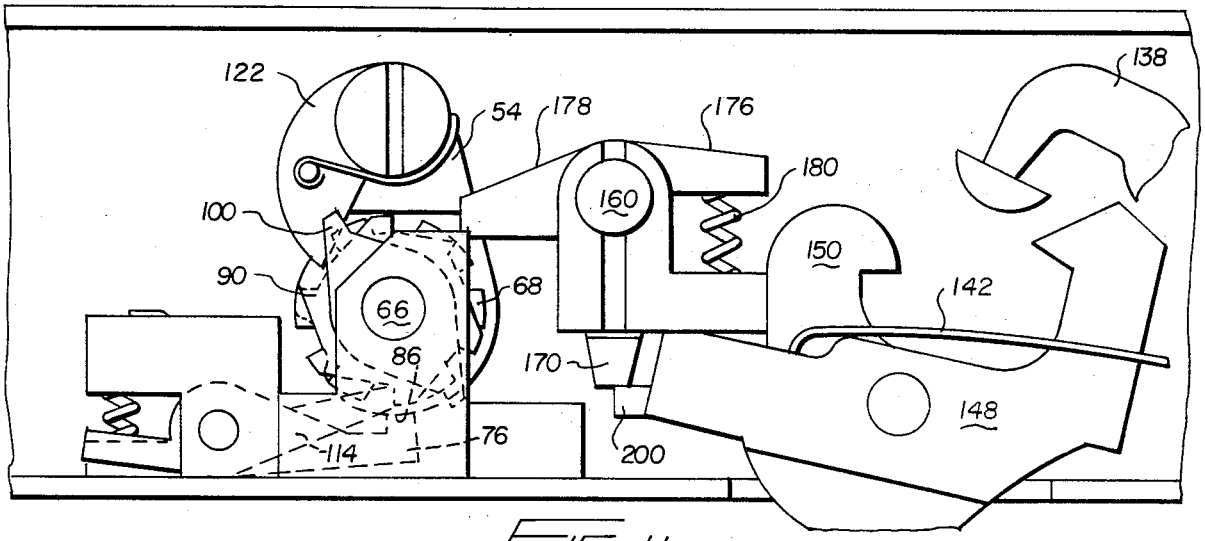
FIG. 11 is a fragmentary side elevational view of a burst fire control mechanism of FIG. 10 after the trigger has been pulled and the hammer has been released; and, FIG. 12 is a fragmentary side elevational view of the burst fire control mechanism of FIGS. 10 and 11 after the round has been fired and the burst fire control mechanism has counted the firing of one round.

Operation of the firearm 10 and the burst fire control mechanism B when the selector blade 170 is in the burst fire configuration is sequentially disclosed in FIGS. 7–8 and 10–12. The selector blade 170 is initially set to rest against rearward portion 200 of disconnector 150 while the hammer cock notch 144 is held by the trigger sear 156, as is best shown in FIG. 10. In FIG. 11, the trigger has been pulled releasing the hammer cock notch 144 from the trigger sear 156 so that the hammer 138 is forced forwardly by means of spring 142 so as to strike the shell (not shown) and to cause the round to be fired. FIG. 11 also discloses that the latch 76 has been cammed free out of engagement of the detents of detent wheel 68 by means of cam surface 86. Consequently, the interconnected detent wheel 68, ratchet wheel 90 and trip pawl 100 are free to rotate when the pawl arm 54 is pivoted from its generally vertical ready position to its pivoted count position. Similarly, FIG. 11 discloses that the hold pawl 114 maintains contact with ratchet teeth 98 of ratchet wheel 90 even during rotation of ratchet wheel 90.

In FIG. 12, the bolt 202 has been rearwardly displaced after the round has been fired and the hammer 138 is pivoted again so as to be adjacent disconnector 150. The bolt 202 engages the top portion of pawl arm 54 and strikes it with sufficient force to cause the pawl arm 54 to rotate on pin 66. The rotary motion of pawl arm 54 on pin 66 is transmitted to the ratchet wheel 90 by means of pawl 122 with the effect that the interconnected detent wheel 68, ratchet wheel 90 and trip pawl 100 are rotated at least 60°. During the rotation it will be noted that the camming surface 84 permits the latch 76 to move upwardly to engage one of the detents of the detent wheel 68 so as to absorb the forces generated on the bolt by its movement rearwardly. The combination detent wheel 68 and latch 76 prevents the ratchet wheel 90 from rotating more than 60° so that the hold pawl 114 may now engage the next one of the ratchet teeth 98. It should be noted that the trip pawl 100 has similarly been incrementally angularly rotated 60°.

As best shown in FIG. 7, after the bolt 202 has been forwardly displaced into battery position, the pawl arm 54 rotates on pin 66 from the angularly rotated count position to the generally vertical upward ready position. The pawl arm 54 is urged into the vertical or ready position by means of spring 186 and the pawl 122 ratchets on the teeth 98 until it engages the appropriate tooth 98 associated with the pawl arm 54 being in the upward or ready position. The spring 188 connected to pawl 122 tends to assure that the tooth engaging portion 130 is always in contact with the ratchet wheel 90 so that the tooth engaging portion 130 is ready to engage the tooth 98.

Figure 13:
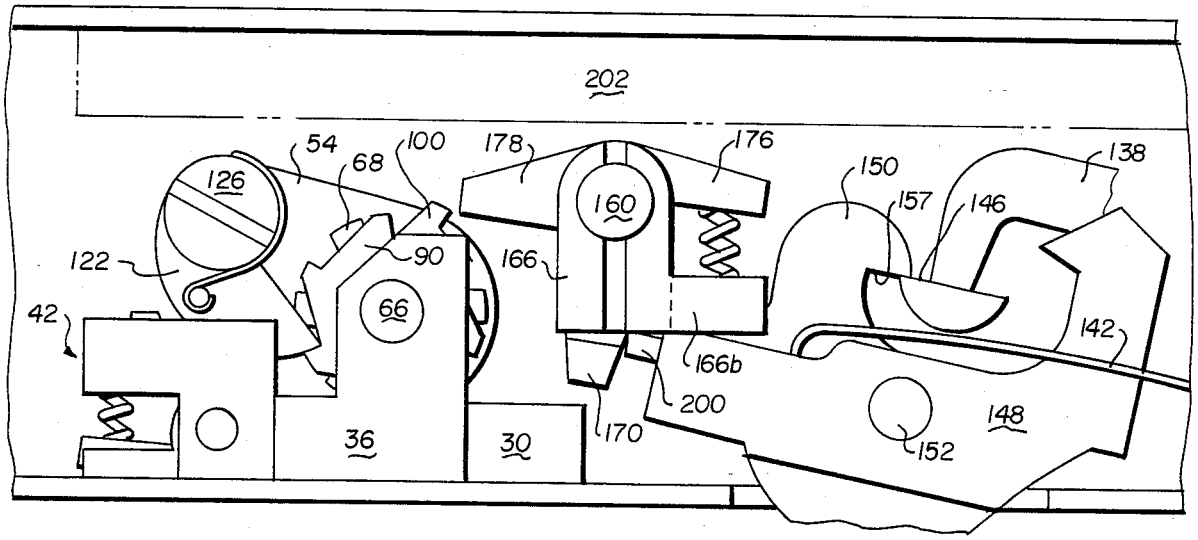
FIG. 13 is a fragmentary side elevational view of the burst fire control mechanism of FIG. 10 after a second round has been fired and a second shot has been counted.

After another round has been fired, as best shown in FIG. 13, the bolt 202 has been rearwardly displaced with the effect that the pawl arm 54 rotates on pin 66 and another shot has been counted. It should be noted that the trip pawl 100 has contacted the rearward arm 178 of selector blade 170 and has tripped the selector blade 170 from the burst fire configuration to the semi-automatic configuration. It should also be noted that the trip pawl 100 rotates past the rearward arm extension 178 in order to prevent binding with the rearward arm 178. After the selector blade 170 has been pivoted to the semi-automatic firing configuration, then the disconnector sear 157 engages the disconnector notch 146 with the result that the trigger must be squeezed for each and every shot subsequent to entering the semi-automatic firing configuration. Burst firing may be reinstated by resetting the selector blade 170 to burst firing configuration by releasing the trigger and resuming the setting of FIG. 10.

The trip pawl 100 has been disclosed as having two outwardly extending arm extensions 110 and 112 but it should be obvious to one skilled in the art that the trip pawl 100 could easily have as many as three or four arms so as to alter the number of shots which could be fired during any burst. Similarly, while the detent wheel 68 has been disclosed as having six detents and the ratchet wheel 90 has been disclosed as having six teeth 98, they likewise could be altered to have a greater or a fewer number of detents and teeth 98 in cooperation with the trip pawl 100 arm extensions with the result that the number of rounds fired per burst can be altered as circumstances would warrant.

The front and back alignment of the trigger assembly 26, the selector blade assembly 158 and the burst fire control mechanism B permits a compact registration and tripping mechanism to be constructed from minimum parts while permitting the recoil energy of the bolt 202 to be utilized to facilitate the counting functions of the burst fire control mechanism B. Similarly, the burst fire control mechanism B has been mounted in a mounting bracket 28 which is removably secured in the frame 134, 162 and 164 of the receiver assembly 14. Should it be desired to alter the number of rounds to be fired per burst, as has been above described, then this alteration can be readily accomplished by means of loosening the screw 132 so as to permit removal of the mounting bracket 28 with its attached parts.

While this invention has been described as having a preferred design, it is understood that it is capable of further modifications, uses and/or adaptations of the invention following in general the principles of the invention and including such departures from the present disclosure as come within known or customary practice in the art to which the invention pertains and as may be applied to the essential features herein before set forth, and fall within the scope of the invention of the limits of the appended claims.

What we claim is:

1. A burst fire control mechanism for an automatic firearm including a bolt longitudinally reciprocally displaceable in a receiver, comprising:

(a) a hammer mechanism having rearward and battery positions pivotally mounted in said receiver for firing a round after being pivoted from said rearward to said battery position;

(b) a trigger assembly pivotally mounted in said receiver rearward of said hammer mechanism and including a portion engagable with said hammer mechanism for permitting said hammer mechanism to pivot between said rearward and said battery position;

(c) selector blade means for pre-selecting a number of rounds to be fired and having safety, semi-automatic, and burst fire firing configurations pivotally mounted in said receiver rearward of said trigger assembly and including means engagable with said trigger assembly for selecting one of said safety, semi-automatic, and burst fire firing configurations;

(d) a burst fire control mechanism mounted in said receiver rearward of said selector blade means;

(e) said burst fire control mechanism including means engagable with said bolt for counting said pre-selected number of fired rounds; and, (f) said burst fire control mechanism when in burst fire firing configuration and when said firearm is fired including means engagable with said selector blade means after said pre-selected number of rounds have been fired and counted for causing said selector blade means to pivot from said burst fire to said semi-automatic firing configuration whereby said selector blade means engages said trigger means thereby selecting said semi-automatic firing configuration to thus interrupt burst firing.

2. A mechanism as defined in claim 1, wherein:

(a) said receiver including a pair of spaced parallel walls; and, (b) said selector blade means spanning said walls.

3. A mechanism as defined in claim 2, further comprising:

(a) mounting bracket means secured in said receiver between said walls; and, (b) said burst fire control mechanism mounted to said mounting bracket means.

4. A mechanism as defined in claim 3, wherein:

(a) said burst fire control mechanism including:

i. pawl arm means mounted to said mounting bracket and pivoting on an axis when engaged by said bolt after firing of a round;

ii. ratchet means connected to said pawl arm means and rotatable on said axis;

iii. trip pawl means secured to said ratchet means and rotatable therewith;

iv. pawl means connected to said pawl arm means spaced from said pawl arm means axis and adapted for engaging said ratchet means for rotating said ratchet means and said trip pawl means therewith when said pawl arm is pivoted by said bolt; and, v. hold pawl means pivotally mounted to said mounting bracket and engagable with said ratchet means for preventing rotation of said ratchet means after said pawl arm has been pivoted by said bolt whereby said trip pawl means engages said selector blade means after said pre-selected number of rounds have been fired and counted by pivoting of said pawl arm means.

5. A mechanism as defined in claim 4, further comprising:

(a) detent wheel means secured to said ratchet means and rotatable therewith; and, (b) latch means pivotally mounted to said mounting bracket and selectively engagable with said detent wheel means for absorbing said recoil forces when said pawl arm is pivoted by said bolt.

6. The mechanism as defined in claim 5, wherein:

(a) said pawl arm means adapted for being pivoted between a ready and a count position; and, (b) said pawl arm means including a camming surface for displacing said latch means free of said detent wheel means when in said ready position to permit free rotation of said ratchet means.

7. The mechanism as defined in claim 6, further comprising:

(a) spring means for pivoting said pawl arm means from said count to said ready position.

8. The mechanism as defined in claim 6, wherein:

(a) said mounting bracket means including a top and a bottom member and two spaced parallel sidewall members; and, (b) said latch means and said hold pawl means coaxially mounted to said sidewall members.

9. A mechanism as defined in claim 8, wherein:

(a) spring means extending from said top member and engaging each of said latch means and said hold pawl means for upwardly displacing said latch means and hold pawl means.

10. The mechanism as defined in claim 5, further comprising:

(a) spring means connected to said pawl and said pawl arm means for maintaining said pawl means in contact with said ratchet means.

11. The mechanism as defined in claim 4, wherein:

(a) said selector blade means including an arm extending longitudinally rearwardly and engagable with said trip pawl means after said pre-selected number of rounds have been fired.

12. The mechanism as defined in claim 11, wherein:

(a) said trip pawl including two opposed arms whereby each of said arms engagable with said selector blade arm after said pre-selected number of rounds have been fired.

13. The mechanism as defined in claim 4, wherein:

(a) said ratchet means including at least six equally angularly disposed teeth engageable with said pawl arm.

14. The mechanism as defined in claim 13, wherein:

(a) said pawl means being pivoted more than 60° but less than 120° when said pawl arm means pivots from said count to said ready position whereby said pawl means may then engage a next one of said ratchet teeth.

15. A mechanism as defined in claim 1, wherein:

(a) said trigger assembly including a trigger pivotally mounted in said receiver;

(b) said trigger further including a disconnector pivotally mounted to said trigger;

(c) said selector blade means engaging said disconnector when in said burst fire firing configuration; and, (d) said selector blade means engaging said trigger when in said safety firing configuration.

16. A mechanism as defined in claim 1, wherein:

(a) said selector blade means including a handle external of said receiver to thereby permit initial selection of one of said firing configurations.

17. The mechanism as defined in claim 1, further comprising:

(a) lever means pivotally disposed in said receiver and engagable with said pawl arm means to prevent interruption of said burst firing.

18. The mechanism as defined in claim 1, wherein:

(a) said trigger pivot below said selector blade means pivot and said burst fire control mechanism pin claim 1, wherein:

(a) said trigger pivot below said selector blade means pivot and said burst fire control mechanism pivot.

19. The mechanism as defined in claim 1, wherein:

(a) said burst fire control mechanism pivot above said trigger pivot and below said selector blade means pivot.

20. A burst fire control mechanism for an automatic firearm including a bolt longitudinally reciprocally displaceably disposed in a frame and further including a hammer assembly and an associated trigger mechanism, comprising:

(a) a mounting bracket secured to said frame longitudinally rearwardly spaced from said trigger mechanism;

(b) selector blade means pivotally mounted to said frame between said mounting bracket and said trigger mechanism and having a portion engagable with said trigger mechanism for selecting one of safety, semi-automatic, and burst fire firing configurations;

(c) pawl arm means reciprocally pivotally secured to said mounting bracket and adapted for being pivoted on an axis between a ready and count position by engagement with said bolt as said bolt is rearwardly displaced;

(d) ratchet means rotatably and coaxially connected to said pawl arm means;

(e) trip pawl means coaxially secured to said ratchet means and rotatable therewith;

(f) pawl means connected to said pawl arm means spaced from said axis and engagable with said ratchet means for rotating said ratchet means and said trip pawl means when said bolt pivots said pawl arm means from said ready to said count position;

(g) hold pawl means pivotally mounted to said mounting bracket and engagable with said ratchet means for preventing rotation of said ratchet means when said pawl arm means pivots from said count to said ready position; and, (h) said trip pawl means engagable with said selector blade means for tripping said selector blade means from said burst fire to said semi-automatic firing configuration after a pre-selected number of rounds have been fired.

* * * * *